United States Patent [19]

Odo et al.

[11] Patent Number: 4,702,201

[45] Date of Patent: Oct. 27, 1987

[54] SOUNDPROOF TYPE ENGINE WORKING MACHINE

[75] Inventors: Satoshi Odo, Saitama; Tetsuo Iida, Kanagawa; Atsushi Abe; Makoto Tsuchida, both of Saitama, all of Japan

[73] Assignee: Honda Giken Kogyo Kabushiki Kaisha, Tokyo, Japan

[21] Appl. No.: 915,118

[22] Filed: Oct. 3, 1986

[30] Foreign Application Priority Data

Oct. 4, 1985 [JP] Japan ..... 60-151518[U]
Oct. 31, 1985 [JP] Japan ..... 60-166601[U]
Oct. 31, 1985 [JP] Japan ..... 60-166602[U]

[51] Int. Cl.[4] ..... F02B 63/00

[52] U.S. Cl. ..... 123/2; 60/721; 290/1 A

[58] Field of Search ..... 60/721; 123/2; 290/1 A, 290/1 B, 1 R

[56] References Cited

U.S. PATENT DOCUMENTS 4,608,946 9/1986 Tanaka et al. ..... 290/1 A

FOREIGN PATENT DOCUMENTS 197417 11/1983 Japan ..... 290/1 A
463796 7/1975 U.S.S.R. ..... 290/1 A

*Primary Examiner*—Stephen F. Husar

*Attorney, Agent, or Firm*—Lyon & Lyon

[57] ABSTRACT

A soundproof type engine working machine comprising a soundproof casing containing therein an engine and a working machine such as for example a dynamo driven by the engine and situated one behind another in the rotary axis direction. In this engine working machine, a main air inlet port into the soundproof casing is formed in a bottom portion of the soundproof casing and at the side where the working machine is situated, a fan for cooling the working machine is mounted to the working machine and a fan for cooling the engine is mounted to the engine, respectively, and a fan cover for covering the engine cooling fan is communicated with a duct covering a cylinder portion of the engine and an exhaust muffler and opened up outside of the soundproof casing at an end portion thereof, a cooling air by the working machine cooling fan being introduced to the duct after the air cooled the working machine. An oil pan cooling air passage is disposed along an oil pan portion of the engine. This oil pan air passage is communicated at its one end with the fan cover and is permitted to penetrate at its other end through a bottom portion of a soundproof casing and opened up outside of the casing. The engine is provided with a recoil starter mounting portion. Within the casing, a battery installing space is defined adjacent to a space occupied by the recoil starter mounted to the recoil starter mounting portion.

5 Claims, 9 Drawing Figures

SOUNDPROOF TYPE ENGINE WORKING MACHINE

BACKGROUND

The field of the present invention is soundproof engine working machines of the type comprising a soundproof casing containing an engine and a working machine such as a dynamo, a compressor and the like driven by the engine.

Engine working machines in which an engine and a working machine such as a dynamo, a compressor, etc. driven by the engine are unified are generally used at construction sites. These frequently employ a soundproof type structure, in which the entire equipment is covered with a soundproof casing in order to maintain the running noise as low as possible.

In a soundproof engine working machine of this kind, the ports through the casing such as an air inlet port, an exhaust port, etc. are made as small as possible in order to minimize noise as mentioned above. Since the openings are small in size, cooling of the inside of the soundproof casing, and particularly in an air cooled type wherein cooling water is not used, is difficult as is positioning of heat emitting devices such as engine, muffler, dynamo, etc. in relation to other devices and cooling systems.

Due to the foregoing, cooling fans driven by engines have been provided within such soundproof casings. Such devices are then ventilated by such cooling fans. For example, in Japanese Laid-open utility model publication No. Sho 58-109519, there is disclosed a soundproof type engine dynamo wherein an engine and a dynamo are provided with cooling fans. In this soundproof type engine dynamo, cooling air produced by the dynamo cooling fan is, after it has cooled the dynamo, introduced to an air duct provided on an under surface of a crankcase of the engine to cool the under surface of the engine. The cooling exhaust air passed through the air duct is attracted by the engine cooling fan together with the air which has cooled the cylinder portion of the engine and is exhausted outside through an exhaust duct.

A similar soundproof type engine working machine is also disclosed in Japanese Laid-open utility model publication No. Sho 56-49234. In this engine working machine, cooling exhaust air forced to flow along an under surface of a crankcase by a dynamo cooling fan in the same manner as described above is joined with the engine cooling exhaust air discharged by an engine cooling fan and exhausted outside.

However, in such a soundproof type working machine wherein the cooling exhaust air at the working machine side and the cooling exhaust air at the engine side are joined and exhausted together, unless performance characteristics of the working machine cooling fan and the engine cooling fan are properly adjusted together, the streams of air do not flow smoothly. This can often result in lower cooling effects for either the working machine or engine or both.

For example, in the first described engine dynamo, if the air flow of the dynamo cooling fan is too great, the amount of cooling air for the cylinder portion attracted by the engine cooling fan becomes so small as to lower the cooling effect for the cylinder portion. On the other hand, in the second described engine dynamo, if the discharge air pressure of the engine cooling fan is too high, the flow rate of the dynamo cooling fan is restricted by the high pressure and reduces the amount of the cooling air for the dynamo and the lower portion of the crankcase. This often results in lowering cooling efficiency for these portions.

Although the above-mentioned conventional machines employ suction fans, similar problems exist in machines of the type which employ forcing fans for forcing cooling air into an engine or dynamo.

Further, there is known, by Japanese utility model publication No. Sho 44-3686, a soundproof type engine in which a duct for covering the cylinder head of an engine and a muffler is provided. Cooling air is force-ventilated by a fan through the duct. The cylinder head and the muffler are cooled and the heated air is discharged outside of a soundproof casing. This soundproof type engine is not integrally formed with a working machines and, as a matter of course, does not include a cooling means for the working machine. Also, in this soundproof type engine, no consideration is given to cooling with respect to an oil pan in a lower portion of the crankcase. However, when an engine is large, cooling with respect to the oil pan portion is desired. In this engine, if the oil pan portion is cooled by cooling air which is force-ventilated through the duct, there arises the problem that ventilation resistance is increased and sufficient cooling is not effected unless the discharge pressure of the fan is increased.

In the aforementioned engine working machines, there are cases where a recoil starter is required which in turn requires a starter motor. These components require additional space in the case. A space may then be required for installing a battery to serve as a power source of the motor. In conventional soundproof type engine working machines, the battery is situated at a rear location of a main body of the engine working machine as shown, for example, in Japanese utility model publication No. Sho 51-23016. Alternatively, the battery may be separately situated from the main body of the engine working machine to avoid cooling problems as shown, for example in Japanese utility model publication No. Sho 59-39151. With such systems where a recoil starter is employed with a soundproof type engine working machine, it is unavoidable that the entire machine becomes large in bulk.

SUMMARY OF THE INVENTION

It is therefore a principal object of the present invention to provide a soundproof type engine working machine which can effectively cool both the engine and the working machine.

It is another object of the present invention to provide a soundproof type engine working machine, wherein an oil pan portion as well as a cylinder portion of the engine and an exhaust muffler can be effectively cooled by an engine cooling fan.

It is a further object of the present invention to provide a soundproof type engine working machine, wherein cooling air, heated after use for cooling and exhausted outside of a soundproof casing, is not recycled back within the soundproof casing so that cooling efficiency is not lowered.

It is a still further object of the present invention to provide a soundproof type engine working machine, wherein running noise is low.

It is a yet further object of the present invention to provide a soundproof type engine working machine, wherein one machine can accommodate both a recoil starter and starter motor in a space within a soundproof casing which is effectively used to make the entire machine smaller.

According to the present invention, in a soundproof type engine working machine wherein an engine and a working machine driven by the engine are arranged one behind another in a rotary shaft direction and enclosed within a soundproof casing, a main air intake port is formed on a bottom portion of the casing at the side where the working machine is situated. A working machine cooling fan is provided to the working machine and an engine cooling fan is provided to the engine. A fan cover for covering the engine cooling fan communicates with a duct covering the cylinder portion of the engine and an exhaust muffler. The duct is opened up outside of the soundproof casing at an end portion thereof, and cooling air produced by the working machine cooling fan is introduced to the duct after cooling the working machine.

The engine cooling fan has a greater suction capacity than the working machine cooling fan and draws a large flow of air introduced within the soundproof casing via the main air inlet port. Accordingly, in spite of the fact that the main air inlet port is situated closer to the working machine side, the cooling air flow attracted to the working machine by the working machine cooling fan is small, and the main volume of air is attracted to the engine side by the engine cooling fan. As a result, a suitable amount of cooling air corresponding to the respective heating values is distributed to the working machine side and the engine side, thereby effecting an efficient cooling. Further, there is produced a continuous flow of cooling air proceeding toward the engine side from the working machine side within the soundproof casing. Due to the foregoing, since a stagnated portion of air within the soundproof casing is eliminated, a region of high temperature is not created. The air which has cooled the working machine is then guided to the duct covering the exhaust muffler and serves for cooling the exhaust muffler.

In another aspect of the present invention, there is provided a soundproof type engine working machine as mentioned which includes an oil pan cooling air passage disposed along the oil pan portion of the engine. The passage communicates with the fan cover and penetrates through a bottom portion of the soundproof cover to open up outside of the soundproof cover.

In such a soundproof type engine working machine as mentioned above, various parts of the engine can be effectively cooled by increasing the flow rate of the engine cooling fan without interference among cooling flows produced by the working machine cooling fan and the engine cooling fan.

In a further aspect of the present invention, there is provided a soundproof type engine working machine, wherein a recoil starter mounting portion is provided on the engine and a space for situating a battery therein is formed adjacent to a space occupied by a recoil starter mounted to the recoil starter mounting portion within the soundproof casing. Such a soundproof type engine working machine can accommodate a recoil starter and a starter motor as one machine, and the entire machine can be made small.

DETAILED DESCRIPTION OF THE PREFERRED EMBODIMENTS

Figure 1:
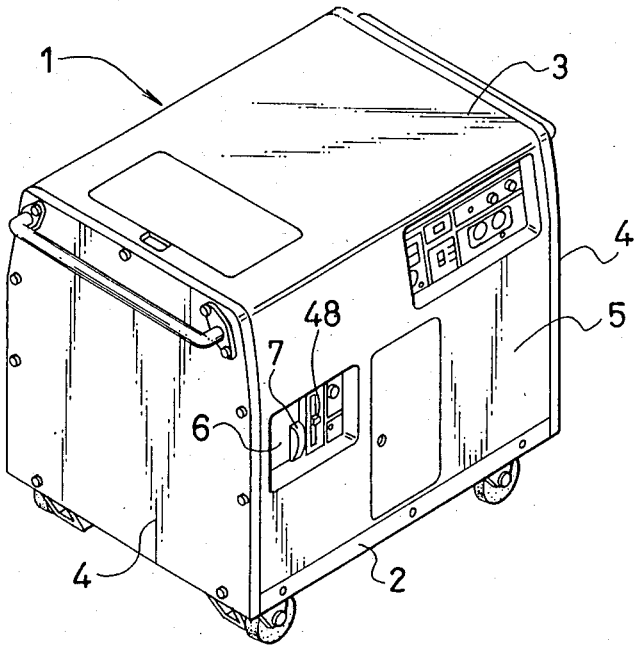
FIG. 1 is a perspective view of an outer appearance of a soundproof type engine working machine according to the present invention.

One preferred embodiment of the present invention will be described hereunder with reference to the accompanying drawings. FIG. 1 is a perspective view showing an outer appearance of a soundproof type engine working machine according to the present invention which is covered with a soundproof casing 1. Within the casing 1, an engine, a working machine (a dynamo in this embodiment) and devices annexed thereto are contained. Attached to an internal surface of the soundproof casing is a noise insulating material such as, for example, glass wool, etc., so that noises generated by internal devices will not be escaped outside.

The soundproof casing 1 comprises a bottom wall member 2, a main cover 3 having a reversed U-shape in section and firmly secured to the bottom wall member 2 along a side marginal portion thereof by screw or the like and end plates 4 for covering both end portions of the main cover 3. A side wall 5 of the main cover 3 is provided with an operation panel 6 arranged thereon with various kinds of members for operating the engine. The illustrated operation panel 6 is of a recoil starter specification and provided with a recoil starter grip 7.

Figure 2:
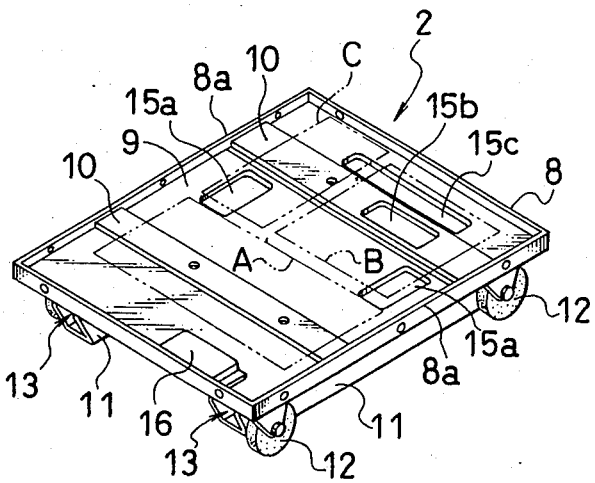
FIG. 2 is a perspective view of a bottom wall member of the soundproof type engine working machine.

The bottom wall member 2, as shown in FIG. 2, is surrounded by a margin member 8 for mounting the main cover 3 and the end plate 4 along four peripheries thereof. The margin member 8 is attached at the internal portion with a bottom plate 9. Arranged between the margin members 8*a*, 8*a* extending along both side portions are reinforcing plates 10, 10, on which an engine and a dynamo are mounted. In the figure, a portion encircled with a chain line A is a place for installing the engine, while a portion encircled with a chain line B is a place for installing the dynamo. Disposed to a portion encircled with a chain line C are an engine exhaust system including a muffler and a duct for covering the exhaust system and introducing air which cooled the engine and the dynamo to a discharge port at a rear location thereof. It is understood that the terms "front location" and "rear location" of the engine working machine refer, for the former, to the left of FIG. 2 and, for the latter, to the right in FIG. 2.

An under surface of the bottom wall member 2 is provided with a pair of channel members 11 extending fore and aft along both sides thereof. Pivotally supported by each of the channel members 11 are moving wheels 12. An outer air is introduced to an internal portion of the channel member 11 through openings 13 formed in end portions thereof and openings 14 (see FIG. 4) formed in a side wall portion thereof. And, such introduced air is intaken within the casing 1 via an air inlet port 15*a*. The bottom plate 9 is provided at a rear portion with further air inlet ports 15*b* and 15*c*. The outer air is also introduced within the casing 1 through these air inlet ports 15*b* and 15*c*. The air introduced through the respective air inlet ports 15*a*, 15*b* and 15*c* is partly intaken into a cylinder of the engine as a fuel combustion air, while the remainder is used for cooling the dynamo and the engine, and these airs are discharged backward via an exhaust system and a duct disposed to the aforementioned chain line portion C respectively. Reference numeral 16 denotes a battery mounting table as will be described hereinafter which is firmly secured to a front portion of the bottom plate 9.

Next, there will be described respective devices disposed within the soundproof casing 1 of FIG. 1 and on the bottom wall member 2 of FIG. 2.

Figure 3:
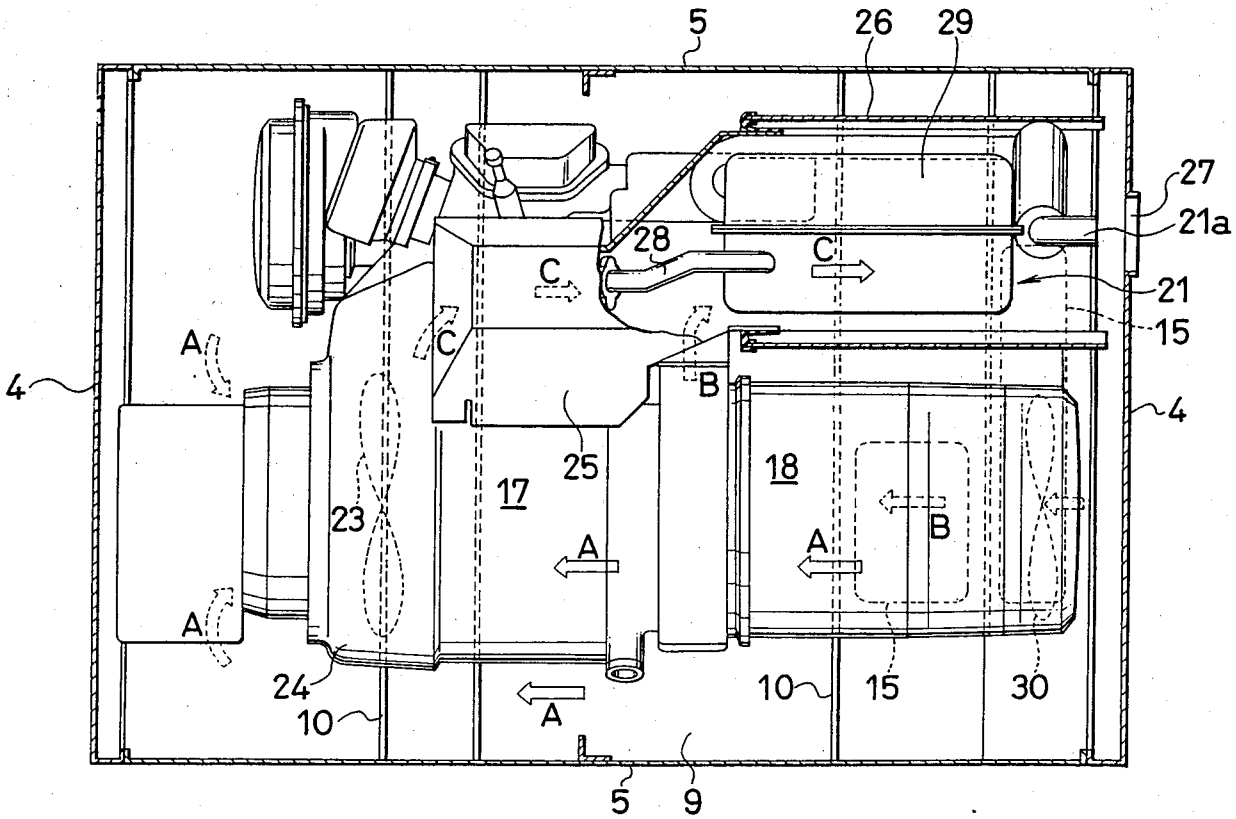
FIG. 3 is a plan view showing an inside of a soundproof cover of the engine working machine.
Figure 4:
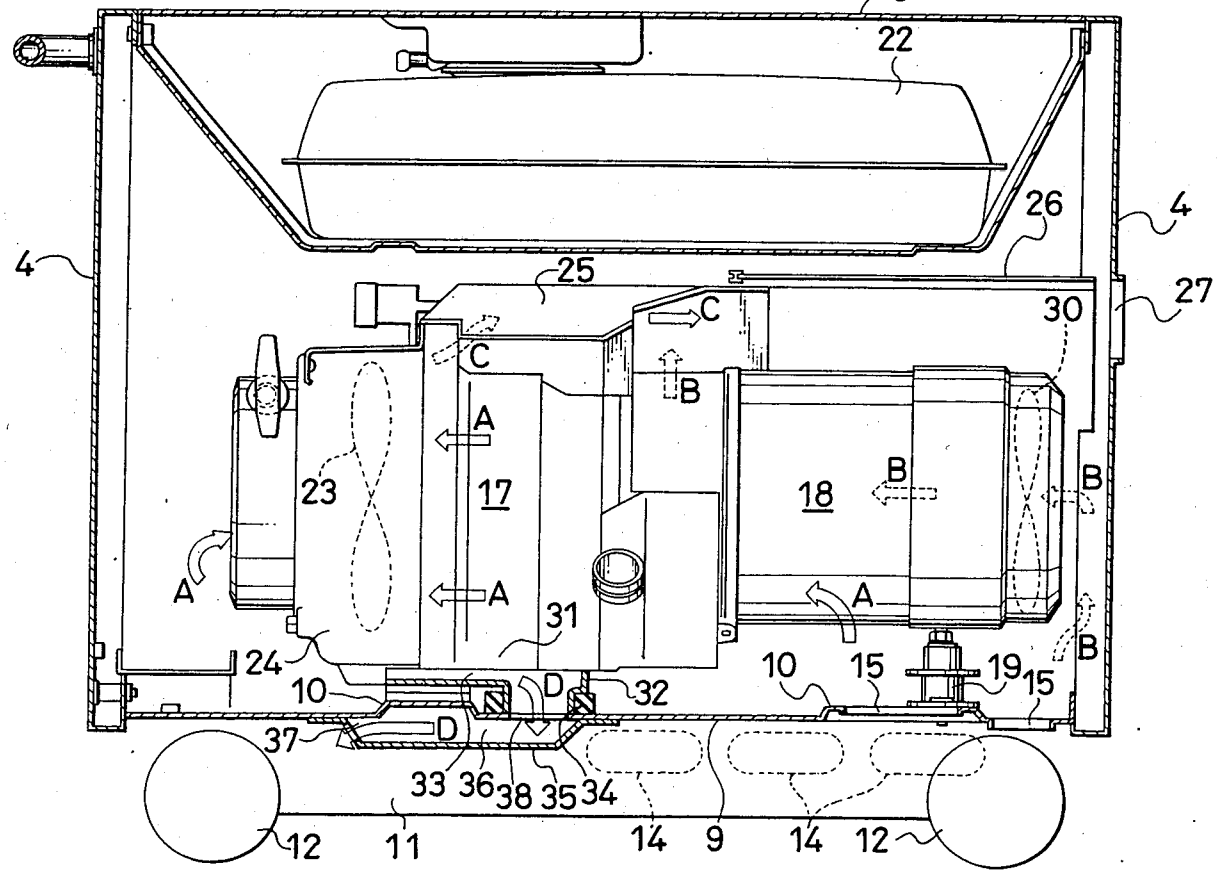
FIG. 4 is a side view thereof showing particularly an oil pan cooling air passage in great detail.
Figure 5:
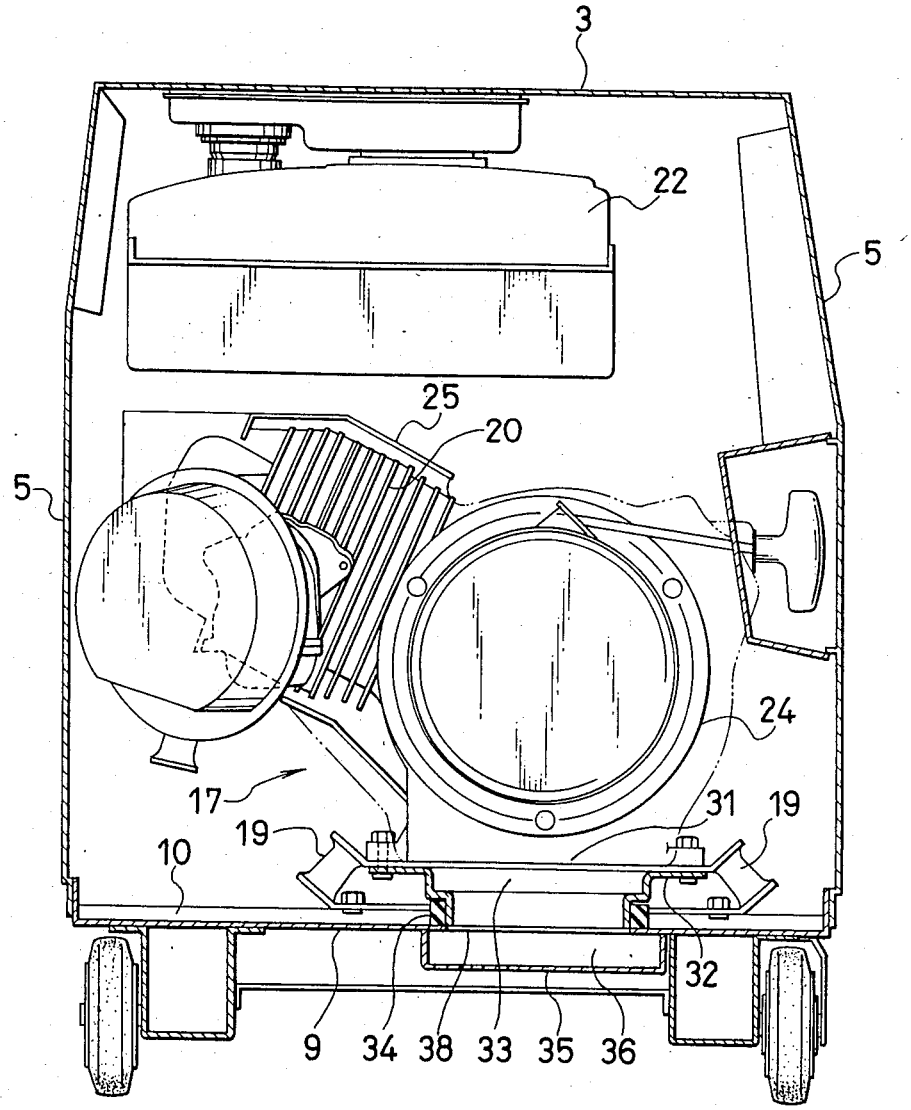
FIG. 5 is a front view thereof.
Figure 6:
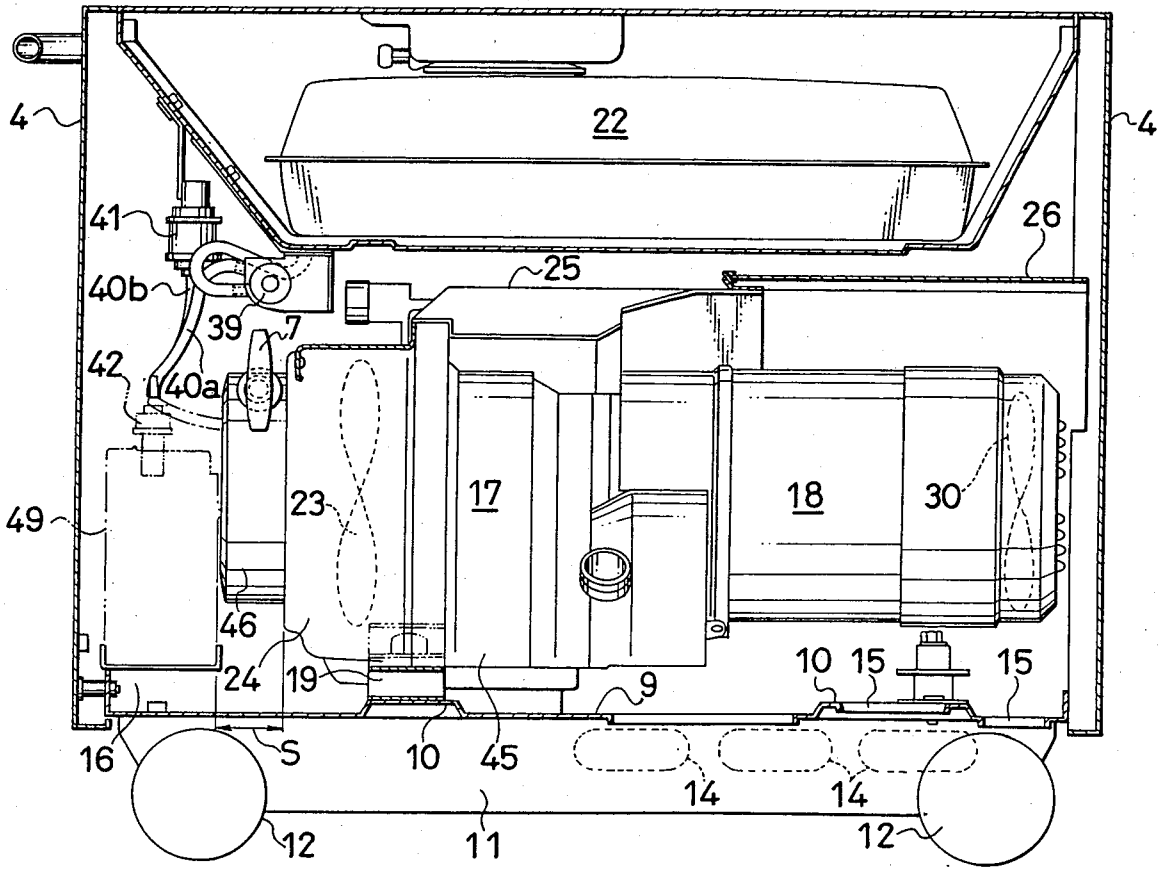
FIG. 6 is a side view similar to FIG. 4 and showing particularly a recoil starter and a fuel system in great detail.
Figure 7:
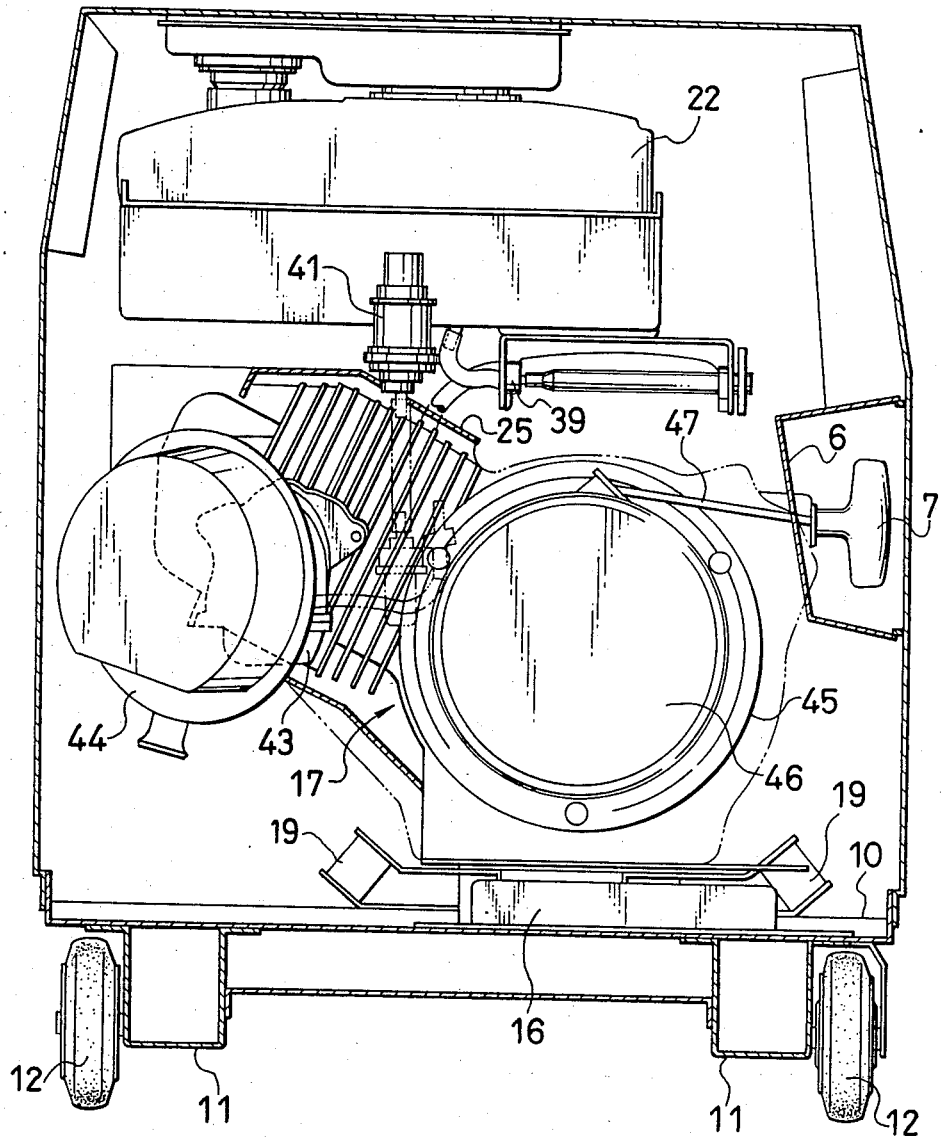
FIG. 7 is a front view thereof.

FIGS. 3 through 5 are a plan view, a side view and a front view respectively showing an inside of the casing 1.

A dynamo 18 is disposed behind an engine 17 with an input shaft thereof directly connected with an output shaft of the engine 17. The engine 17 and the dynamo 18 are mounted on the reinforcing plates 10, 10 through a rubber mount 19 respectively. The engine 17, as shown in FIG. 5, is disposed in a low posture with a cylinder 20 inclined sideward. Disposed to a space portion formed at a rear location of the cylinder 20 and a side location of the aforementioned dynamo 18 is an exhaust system of the engine including an exhaust muffler 21. At the inside and upper part of the soundproof casing, a fuel tank 22 is disposed.

The engine 17 is provided with an engine cooling fan 23 mounted to an outer end of a crank shaft thereof. The engine cooling fan 23 is covered with a fan cover 24. The fan cover 24 is communicated with a shroud 25 for covering the cylinder 20. The shroud 25 extends backward to communicate with a muffler duct 26 (FIG. 3). A terminal end portion of the muffler duct 26 is opened up outside of the soundproof casing through an exhaust air port 27 formed in the rear end plate 4. The aforementioned exhaust muffler 21 is disposed within this muffler duct 26. An engine exhaust enters into an exhaust chamber 29 of the exhaust muffler 21 through an exhaust pipe 28 and is then discharged outside from an outlet portion 21*a* at a rear upper portion. In this way, a duct is formed by the shroud 25 and the muffler duct 26, which covers the cylinder portion 20 of the engine 17 and the exhaust muffler 21 and communicates at the terminal end portion with the outside through the exhaust air port 27.

The dynamo 18 is also built in at a rear end portion thereof with a dynamo cooling fan 30. An air intaken within the dynamo 18 by the dynamo cooling fan 30, as shown by a dotted line arrow B of FIG. 4, passes through the inside of the dynamo 18 for cooling and is thereafter discharged into the aforementioned duct from a front part thereof.

The bottom plate 9 of the soundproof casing, as described above, is provided with the air inlet port 15 at a rear portion thereof, i.e., the side where the dynamo 18 is situated. The engine cooling fan 23 is larger in capacity than the dynamo cooling fan 30 and exerts a large attracting force to the air introduced within the casing via the air inlet port 15. Accordingly, in spite of the fact that the air inlet port 15 is situated nearer to the dynamo 18 side, a cooling air amount intaken to the dynamo 18 by the dynamo cooling fan 30 at a near location is small, and the remaining large amount of air is attracted to the engine 17 side by the engine cooling fan 23. As a result, a suitable amount of cooling air corresponding to the respective heating values is distributed to the working machine side and the engine side, thereby to effect an efficient cooling. Further, there is produced within the machine a continuous flow of cooling air which is given a directional characteristic toward the front engine 17 side from the rear dynamo 18 and muffler duct 26 side as shown by a solid line arrow A. Due to the foregoing, since a stagnated portion of air within the machine (an outer side of dynamo, duct and engine) is eliminated, there will not produce a partially high temperature portion.

In this way, the cooling air A reaching the front portion of the engine 17 is drawn within the fan cover 24 by the engine cooling fan 23. A part of the air, as shown by an arrow C, flows through the inside of the shroud 25 communicates with the fan cover 24 and along the cylinder of the engine 17 and is fed into the muffler duct 26 after cooling the cylinder 20. While the air flows within the muffler duct 26, it cools the exhaust pipe 28, and the exhaust muffler 21 and is discharged outside through the exhaust air port 27. As described previously, the cooling air of the dynamo 18 is also force-ventilated within the muffler duct 26, thereby to serve for cooling the exhaust muffler 21, etc.

The engine cylinder portion is cooled in the manner as described above. The oil pan portion 31 on the lower portion of the crankcase is cooled from outside by the cooling air from the engine cooling fan 23. To this end, a ducting member 32 is fastened with the rubber mount 19 for supporting the engine 17 and firmly secured to the outer surface of the oil pan portion 31. This ducting member 32 is an integrally press molded article, and an oil pan cooling air passage 33 is formed at the internal portion thereof. And, the front end portion of this oil pan cooling air passage 33 is communicated with the inside of the fan cover 24, while the rear end portion thereof is warped downward and opened to the outside through a hole 38 formed in the bottom plate 9 of the casing. The ducting member 32 is resiliently supported at this opening portion by a cylindrical rubber member 34 with respect to the bottom plate 9. This rubber member 34 has the role of supporting the ducting member 32 integrally vibrating with the engine 17 on the bottom plate 9 so as to cut off the vibration and sealing the oil pan cooling air passage 33. The cooling exhaust air within the oil pan cooling air passage 33 may then not leak within the soundproof casing from the aforementioned opening. The bottom plate 9 is provided at its under surface with an air ducting plate 35 disposed in such a manner as to cover the opening of the oil pan cooling air passage 33. The air ducting plate 35 extends forward along the bottom plate 9 while defining an air ducting passage 36 between the under surface of the bottom plate 9 and itself, and the front end thereof is formed with an exhaust air port 37. Accordingly, a part of the cooling air drawn within the fan cover 24 by the engine cooling fan 23, as shown by an arrow D, is guided to the oil pan cooling air passage 33 from the fan cover 24 and discharged forward from the exhaust air port 37 via the air ducting passage 36 after cooling the oil pan portion 31.

In this embodiment, as described above, although the cylinder 20, the exhaust muffler 21 and the oil pan portion 31 are cooled by discharge air of the engine cooling fan 23, the passage for the cooling air C for cooling the cylinder 20 and the exhaust muffler 21 and the passage for the cooling air D for cooling the oil pan portion 31 are branched off with respect to each other to form a parallel relation and communicated with outside respectively. Accordingly, in spite of the fact that two portions, namely the cylinder, exhaust muffler portion and the oil pan portion, are cooled by one engine cooling fan 23, a large amount of air can flow to the two portions respectively by a comparatively low discharge pressure, thereby effectively cooling the entire engine.

Although the cooling exhaust air B after cooling the dynamo 18 is joined within the duct (shroud 25 and the muffler duct 26) which forms the passage for the cooling air C, since the pressure of the cooling air C is comparatively low because of the reason mentioned in the foregoing, the cooling exhaust air B smoothly flows into the duct, and the dynamo 18 is also effectively cooled by a sufficiently large amount of cooling air.

In this embodiment, at least the main air inlet port 15 is provided at the dynamo 18 side of the bottom plate 9, while the outlet port of the oil pan cooling air passage 33 is disposed at a lower location of the dynamo 18 and separated from the air inlet port 15. Moreover, the cooling exhaust air discharged from the oil pan cooling air passage 33 is guided further forward from the air inlet port 15 along the air ducting passage 36 and discharged at the exhaust air port 37 in the opposite direction with respect to the air inlet port 15. Accordingly, the cooling exhaust air which cooled the oil pan portion 31 and was heated thereby is not drawn again into the casing from the air inlet port 15 which would otherwise lower the cooling efficiency of the engine 17 and the dynamo 18.

Furthermore, since the air inlet port 15 and the exhaust air port 37 open up in a space between the bottom plate 9 and the ground under the bottom plate 9, noises escaping outside of the casing from these ports are blocked by the ground, thereby reducing running noise.

The ducting member 32 is firmly secured to the engine 17. It is supported at the outlet port and its vicinity by the bottom plate 9 of the casing and always held in a position aligned with the aforementioned hole 38 of the bottom plate. Since this support is made through the vibration proofing member or cylindrical rubber member 34, vibration of the engine 17 will not be spread to the bottom plate 9 through the air ducting member 32. The rubber member 34 also functions as a sealing member for sealing the outlet port of the air ducting member 32 from the inside of the casing.

A soundproof type engine dynamo as shown in FIGS. 6 through 9 is substantially the same as the above-described soundproof type engine dynamo. However, there are shown in FIGS. 6 through 9 a fuel system, a battery, etc. which are not shown in FIGS. 3 through 5. Described hereunder is a soundproof type engine dynamo having a recoil starter and starter motor with reference to FIGS. 6 through 9.

Fuel within a fuel tank 22 is fed to a carburetor 43 by a fuel pipe 40*a* opened and shut by a manually operated cock 39 or an automatic cock 41 comprising a solenoid valve through a common strainer 43.

The combustion air is intaken into the cylinder of the engine 17 through an air cleaner 44 and the carburetor 43. This fuel feed system is disposed within a passage for a cooling air introduction into the casing via the aforementioned respective air inlet ports 15 provided at a rear location of the bottom plate 9, passed along the periphery of the engine 17 from backward to forward attracted by the cooling fan 23, and drawn into a cover 45 from forward and satisfactorily cooled by the cooling air.

A recoil starter 46 can be mounted to the front end face of the fan cover 24 forming a part of the cover 45 by bolts or the like. A rope 47 extending from a mounted recoil starter 46 is connected with the recoil starter grip 7. The rope 47, as known, is wound on a rotary drum energized by a spring provided within the recoil starter 46. By pulling the recoil starter grip 7 to rewind the rope 47 together with the rotary drum, the crank shaft of the engine 17 is rotated to start driving the engine 17. At this time, feed of the fuel is controlled by manipulating the fuel cock lever 48 (FIG. 1) on the operation panel and actuating the manually operated cock 39.

Figure 8:
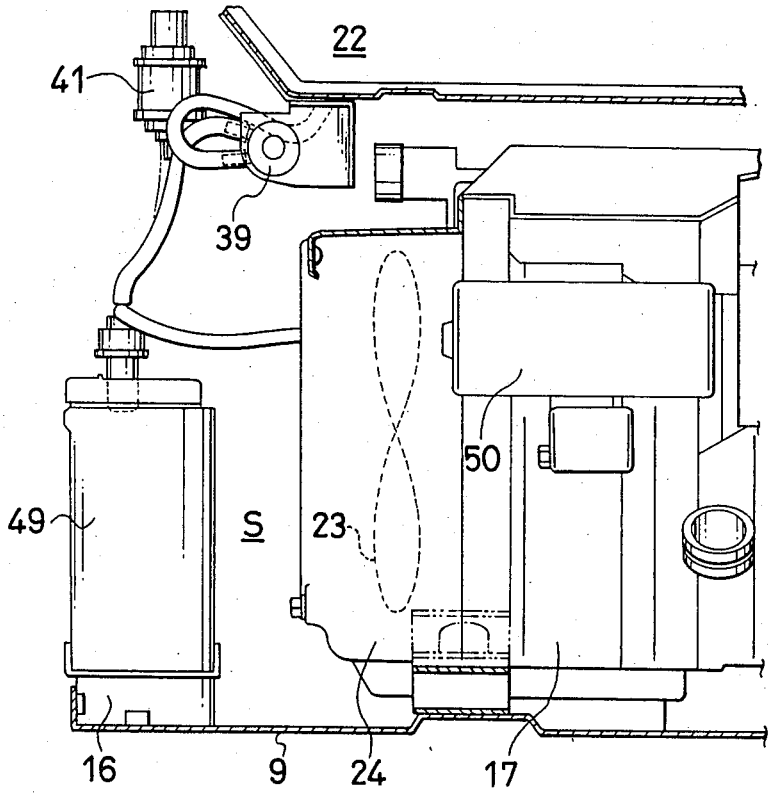
FIG. 8 is a partial side view showing the engine working machine of a starter motor specification.
Figure 9:
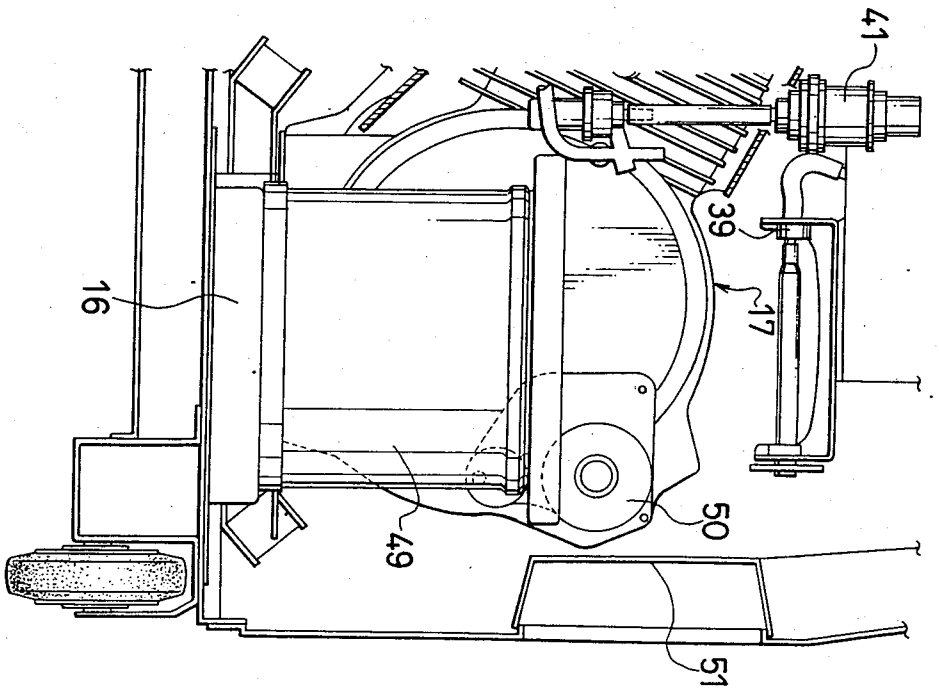
FIG. 9 is a front view thereof.

In order to modify the engine dynamo of the above-described recoil starter specification to that of the starter motor specification, the recoil starter 46 is removed from the fan cover 24 and the battery 49 is placed on the battery mounting table 16 and firmly secured thereon as shown in FIGS. 8 and 9. This battery 49 is also shown by a chain line in FIG. 6. As apparent from these figures, the space occupied by the recoil starter 46 and the space occupied by the battery 49 are adjacent with each other. Both the spaces may be partly overlapped. The starter motor 50 is mounted to the side portion of the engine 17 so that a flywheel (not shown) will be driven by this starter motor 50. Further, the afore-described operation panel 6 is replaced with the operation panel 51 of the starter motor and required wiring extends among a switch provided on the operation panel 51, the battery 49 and the starter motor 50 so that the starter motor 50 will be started and stopped by the switch serving the battery 49 as a power source. Furthermore, wiring extends between the battery 49 and the solenoid of the automatic cock 41 through a suitable control member and when specified, fuel feed from the fuel tank 22 to the engine 17 is controlled by the automatic cock 41.

In this way, the present embodiment can accommodate both the specifications of the recoil starter and the starter motor. When the recoil starter is used, since the battery 49 has been removed, sufficient space exists for drawing in cooling air around the recoil starter 46, and when the starter motor is used, since the recoil starter 46 is removed, a space S corresponding to the mounting space of the recoil starter 46 is formed between the battery 49 and the front end of the fan cover 24. A sufficient amount of cooling air can be introduced to the engine 17 through this space S, and the battery 49 is satisfactorily cooled by a cooling air flowing the space S. Accordingly, since the mounting position of the recoil starter 46 and that of the battery 49 can be arranged very near with each other, the bottom area can be reduced extensively and the entire machine can be made small when compared with the conventional engine dynamo wherein the battery is separately disposed from the engine dynamo main body, at the rear location or at the side location of the engine dynamo main body.

What is claimed is:

1. A soundproof type engine working machine including an engine and a working machine driven by the engine which are situated one behind another in the rotary shaft direction and enclosed within a soundproof casing including:

a main air inlet port formed in a bottom portion of said soundproof casing and at the side where said working machine is situated;

a working machine cooling fan mounted to said working machine;

an engine cooling fan mounted to said engine;

a duct covering a cylinder portion and an exhaust muffler of said engine and opened up outside of said soundproof casing at an end portion thereof;

a fan cover covering said engine cooling fan and communicating with said duct;

means for introducing a cooling air produced by said working machine cooling fan to said duct after cooling said working machine; and an oil pan cooling air passage disposed along an oil pan portion of said engine, communicated with said fan cover and opened up at an outer portion of said soundproof cover after penetrating through a bottom portion of said soundproof cover.

2. A soundproof type engine working machine as claimed in claim 1, wherein said oil pan cooling air passage is opened up in the direction avoiding said main air inlet port.

3. A soundproof type engine working machine as claimed in claim 2, wherein said oil pan cooling air passage comprises an air ducting member disposed along an outer side of said oil pan portion with one end thereof communicated with said fan cover and with an outlet port of the other end thereof allowed to attend to a hole formed in the bottom portion of said soundproof cover, said air ducting member being fixed to the engine and supported on said bottom portion through a cylindrical vibration-proof material virtually sealing a peripheral portion of said outlet port.

4. A soundproof type engine working machine as claimed in claim 1, wherein said oil pan cooling air passage comprises an air ducting member disposed along an outer side of said oil pan portion with one end thereof communicated with said fan cover and with an outlet port of the other end thereof allowed to attend to a hole formed in the bottom portion of said soundproof cover, said air ducting member being fixed to the engine and supported on said bottom portion through a cylindrical vibration-proof material virtually sealing a peripheral portion of said outlet port.

5. A soundproof type engine working machine including an engine and a working machine driven by the engine which are situated one behind another in the rotary shaft direction and enclosed within a soundproof casing including:

an engine cooling fan mounted to said engine;

a duct covering a cylinder portion and an exhaust muffler of said engine and opened up outside of said soundproof casing at an end portion thereof; and a fan cover covering said engine cooling fan and communicating with said duct;

said engine being provided with a recoil starter mounting portion and a space for situating a battery being defined within said soundproof casing at a location adjacent to a space occupied by a recoil starter mounted to said recoil starter mounting portion.

* * * * *

UNITED STATES PATENT AND TRADEMARK OFFICE

CERTIFICATE OF CORRECTION

PATENT NO. : 4,702,201

DATED : October 27, 1987

INVENTOR(S) : SATOSHI ODO et al.

It is certified that error appears in the above-identified patent and that said Letters Patent are hereby corrected as shown below:

In claim 3, line 2, delete "2" and insert therefor -- 1 --.

In claim 4, line 2, delete "1" and insert therefor -- 2 --.

Signed and Sealed this

Tenth Day of May, 1988

*Attest:*

*Attesting Officer*

DONALD J. QUIGG

*Commissioner of Patents and Trademarks*